US006461151B1

(12) United States Patent
Knoepfel et al.

(10) Patent No.: US 6,461,151 B1
(45) Date of Patent: Oct. 8, 2002

(54) BURNER FOR A HEAT GENERATOR

(75) Inventors: Hans Peter Knoepfel, Dottikon; Thomas Ruck, Rekingen, both of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/531,184

(22) Filed: Mar. 21, 2000

(30) Foreign Application Priority Data

Mar. 31, 1999 (DE) ..... 199 14 666

(51) Int. Cl.[7] ..... F23D 14/46

(52) U.S. Cl. ..... 431/350; 431/354; 431/185; 431/174; 431/9

(58) Field of Search ..... 431/350, 8, 10, 431/351, 353, 354, 12, 183, 185, 9, 159, 174; 239/599, 601; 60/737, 734, 738

(56) References Cited

U.S. PATENT DOCUMENTS

| | | | | | |
|---|---|---|---|---|---|
| 3,617,161 | A | * | 11/1971 | Polidoro | 431/350 |
| 4,201,539 | A | * | 5/1980 | Voorheis | 431/354 |
| 4,562,966 | A | * | 1/1986 | Smith et al. | 239/599 |
| 5,351,475 | A | | 10/1994 | Ansart et al. | 60/39.36 |
| 5,458,484 | A | * | 10/1995 | Ripka | 431/353 |
| 5,643,348 | A | * | 7/1997 | Shamp et al. | 432/196 |
| 5,735,687 | A | | 4/1998 | Knöpfel et al. | 431/354 |
| 5,833,447 | A | * | 11/1998 | Bodelin et al. | 431/10 |
| 5,943,866 | A | * | 8/1999 | Lovett et al. | 60/737 |
| 5,944,511 | A | * | 8/1999 | Ruck | 431/354 |
| 5,984,667 | A | * | 11/1999 | Philippe et al. | 431/10 |
| 6,068,468 | A | * | 5/2000 | Philippe et al. | 431/10 |
| 6,123,542 | A | * | 9/2000 | Joshi et al. | 431/353 |

FOREIGN PATENT DOCUMENTS

| | | | |
|---|---|---|---|
| DE | 1911608 | | 10/1970 |
| DE | 4001378 | C2 | 7/1991 |
| EP | 0797051 | A2 | 9/1997 |
| JP | 11-211091 | A * | 8/1999 |

* cited by examiner

*Primary Examiner*—Henry Bennett
*Assistant Examiner*—Josiah C. Cocks
(74) *Attorney, Agent, or Firm*—Burns, Doane, Swecker & Mathis, L.L.P.

(57) ABSTRACT

According to the invention, in burners having a swirl generator (100), a mixing tube (220) and a combustion chamber (30), the transition from the mixing tube (220) to the combustion chamber (30) is designed with a variable radius over the circumference of the mixing tube (220). As a result, it is possible to form the flame in various shapes—from a circle to an ellipse with a ratio of width to height of 3 at most. The number of burners in a gas turbine may thus be advantageously reduced. Burners of existing gas turbines may be converted in a simple manner.

15 Claims, 3 Drawing Sheets

BURNER FOR A HEAT GENERATOR

BACKGROUND OF THE INVENTION

1. Field of the Invention

The invention relates to a burner for a heat generator, in particular for a gas turbine.

2. Description of the Related Art

EP 797 051 A2 discloses a burner for a gas turbine. For better understanding, this burner is reproduced in FIG. 1. In this burner, which essentially comprises a swirl generator for a combustion-air flow and means for spraying a fuel into the combustion-air flow, a mixing section is arranged downstream of the swirl generator referred to. This mixing section, inside a first part of the section, has a number of transition passages which run in the direction of flow and ensure that the flow formed in the swirl generator is passed over smoothly into a downstream mixing tube. The outlet plane of this mixing tube relative to the combustion chamber is formed with a breakaway edge and a radius, the breakaway edge serving to stabilize and enlarge a backflow zone forming downstream. The breakaway edge and the radius are shown by FIG. 2, which is likewise taken from the publication EP 797 051 A2 and is reproduced here for clarification. Due to the configuration of this burner with the breakaway edge and the radius, a round flame is produced. A plurality of these burners are arranged in an annular manner around the axis of rotation of the gas turbine. However, a disadvantage of this prior art is that a relatively large number of burners are required due to the round flame shape, a factor which entails a cost disadvantage. The burners must be at a minimum distance from the combustion-chamber wall in order not to overheat the latter. On the other hand, the burners must be at a minimum distance from one another in order to permit a uniform temperature distribution and a good cross-ignition behavior.

SUMMARY OF THE INVENTION

The aim of the invention is to overcome the abovementioned disadvantages. The invention achieves the object of conceiving a burner with which the requisite number of burners of a combustion chamber is reduced, although the minimum distance of the burners from the combustion-chamber wall and the temperature distribution or the cross-ignition behavior are to remain the same.

According to the invention, this is achieved in a burner according to the preamble of the independent claim in that the radius is variable over the circumference of the mixing tube.

The radius is advantageously made in such a way that an ellipsoidal transition from the mixing tube to the combustion chamber and consequently an ellipsoidal flame are obtained. The flame shape may thus be varied from a round shape to an ellipse, the ratio of flame width to flame height being 3 at most. Due to a substantially larger width of the flame, the number of burners is markedly reduced while the design criteria remain the same. With this invention, it is also possible to convert existing gas turbines in a simple manner. Owing to the fact that the flame can be configured so as to be variable from a round shape to an ellipsoidal shape, the flame shape may also be individually adapted to a geometrical form of an existing gas turbine.

Only the elements essential for the invention are shown.

DETAILED DESCRIPTION OF THE PREFERRED EMBODIMENTS

Figure 1:
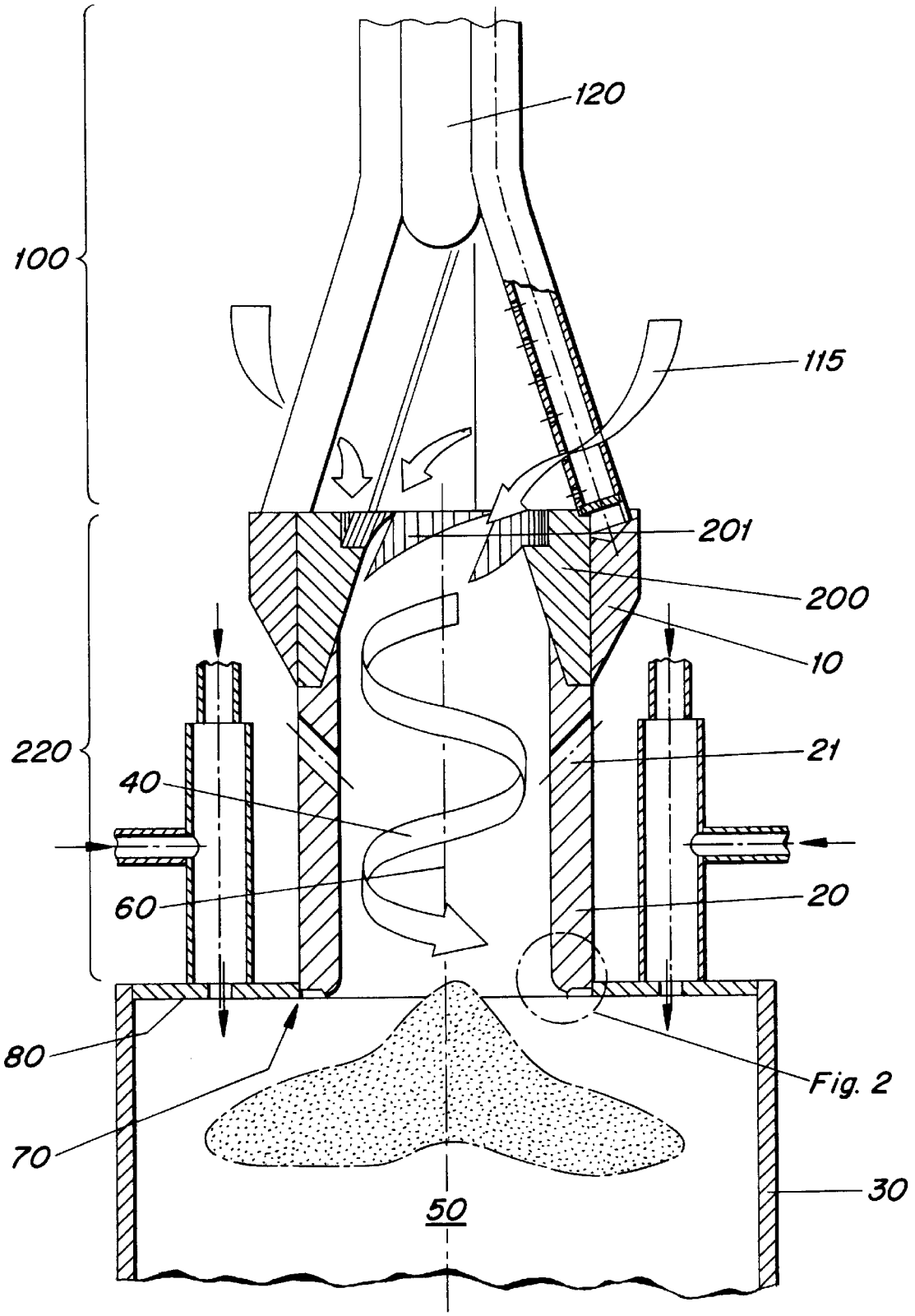
Fig. 1 PRIOR ART
FIG. 1 shows a burner for a heat generator according to the known prior art.

FIG. 1 shows the overall construction of a burner as disclosed by publication EP 797 051 A2. Initially a swirl generator 100 is effective. This swirl generator 100 is a conical structure, preferably a premix burner of the double cone design, the basic construction of which is described in EP 0321809 B1, to which a combustion-air flow 115 entering tangentially is repeatedly admitted tangentially. As shown in FIG. 1 and as is known in the art, a double cone burner includes two hollow, conical sectional bodies which are nested one inside the other in the direction of flow, wherein the respective longitudinal symmetry axes of these sectional bodies run mutually offset in such a way that the adjacent walls of the sectional bodies form ducts, tangential to their longitudinal extend, for a combustion-air flow 115. At least one fuel nozzle 120 can take effect in the interior space formed by the sectional bodies. The flow forming herein, with the aid of a transition geometry provided downstream of the swirl generator 100, is passed over smoothly into a transition piece 200 in such a way that no separation regions can occur there. This transition piece 200 is extended on the outflow side of the transition geometry by a tube 20, both parts forming the actual mixing tube 220, also called mixing section, of the burner. The mixing tube 220 may of course be made in one piece, i.e. the transition piece 200 and the tube 20 are fused to form a signal cohesive structure, the characteristics of each part being retained. If the transition piece 200 and tube 20 are constructed from two parts, these parts are connected by a sleeve ring 10, the same sleeve ring 10 serving as an anchoring surface for the swirl generator 100 at the top. In addition, such a sleeve ring 10 has the advantage that various mixing tubes may be used. Located on the outflow side of the tube 20 is the actual combustion chamber 30, which is symbolized here merely by the flame tube. The mixing tube 220 fulfills the condition that a defined mixing section, in which perfect premixing of fuels of various types is achieved, is provided downstream of the swirl generator 100. Furthermore, this mixing section, that is the mixing tube 220, enables the flow to be directed free of losses so that at first no backflow zone can form even in interaction with the transition geometry, whereby the mixing quality of all types of fuel can be influenced over the length of the mixing tube 200. However, this mixing tube 220 has another property, which consists in the fact that, in the mixing tube 220 itself, the axial velocity profile has a pronounced maximum on the axis, so that a flashback of the flame from the combustion chamber is not possible. However, it is correct to say that this axial velocity decreases toward the wall in such a configuration. In order to also prevent a flashback in this region, the mixing tube 220 is provided in the flow and circumferential directions with a number of regularly or irregularly distributed bores 21 having widely differing cross sections and directions relative to the burner axis 60, through which an air quantity flows into the interior of the mixing tube 220 and induces an increase in the velocity along the wall for the purposes of a prefilmer. Another possibility of achieving the same effect is for the cross section of flow of the mixing tube 220 on the outflow side of the transition passages 201, which form the transition geometry already mentioned, to undergo a convergence, as a result of which the entire velocity level inside the mixing tube 220 is raised. In the figure, these bores 20 run at an acute angle relative to the burner axis 60. Furthermore, the outlet of the transition passages 201 coincides with the narrowest cross section of flow of the mixing tube 220. Said transition passages 201 accordingly bridge the respective difference in cross section without at the same time adversely affecting the flow formed. If the measure selected initiates an intolerable pressure loss when directing the tube flow 40 along the mixing tube 220, this may be remedied by a diffuser (not shown in the figure) being provided at the end of the mixing tube. A combustion chamber 30 adjoins the end of the mixing tube 220, there being a jump in cross section 70, formed by a front wall 80, between the two cross sections of flow. Not until here does a central backflow zone 50 form, which has the properties of a flame retention baffle. If a fluidic marginal zone, in which vortex separations arise due to the vacuum prevailing there, forms inside this jump in cross section 70 during operation, this leads to intensified ring stabilization of the backflow zone 50. The generation of a stable backflow zone 50 requires a sufficiently high swirl coefficient in the relevant tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity.

Figure 2:
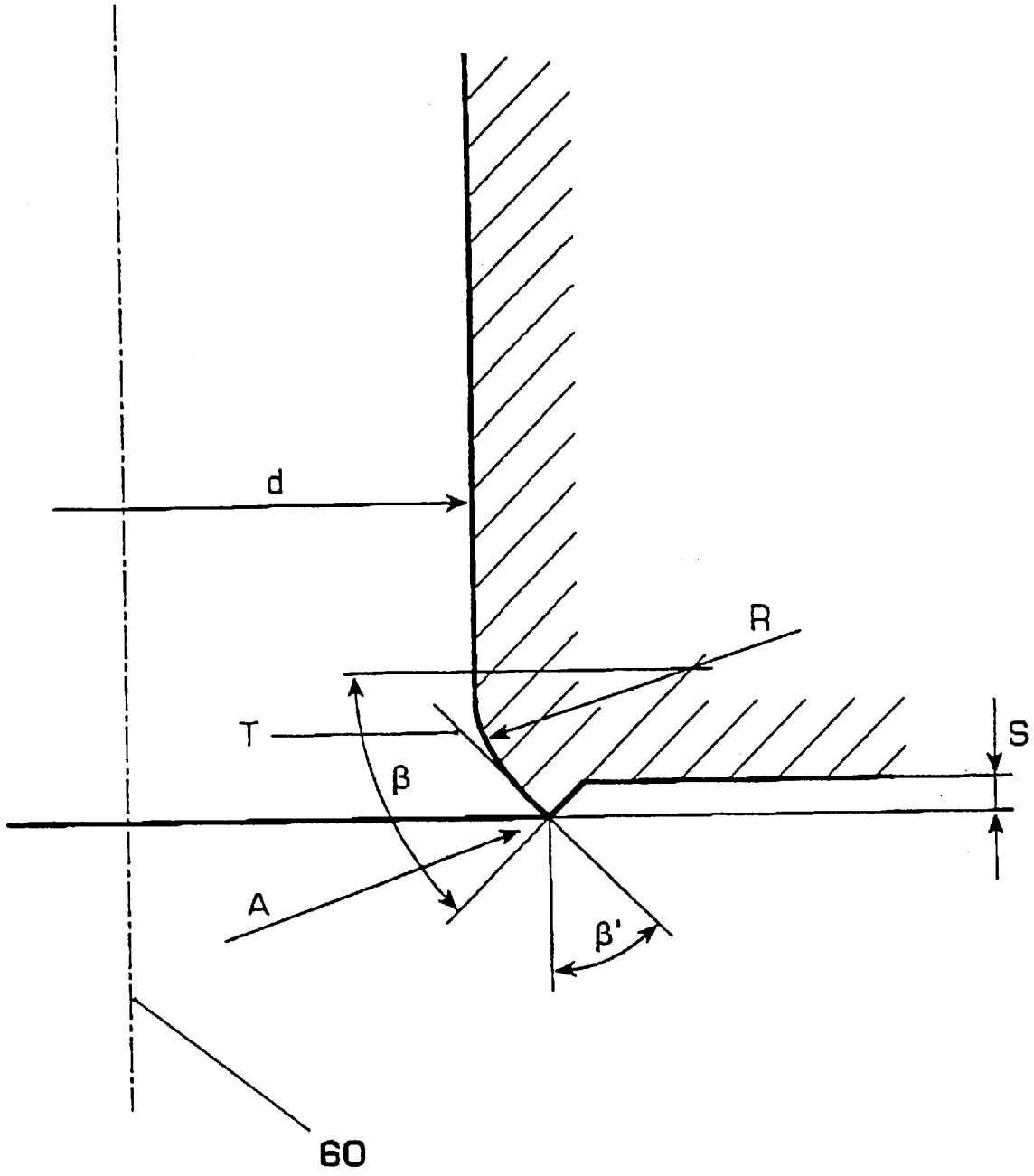
Fig. 2 Prior art
FIG. 2 shows an enlarged detail of FIG. 1 in the region of the breakaway edge between the mixing tube of the burner and the combustion chamber.

FIG. 2 (prior art according to EP 797 051 A2) shows the breakaway edge A already discussed, which is formed at the burner outlet between the mixing tube 20 and the combustion chamber 30. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is >10% of the inside diameter d of the tube 20. Compared with a flow without a radius, the backflow bubble 50 is now hugely enlarged. This radius R runs up to the outlet plane of the tube 20, the angle β between the start and the end of the curvature being <90°. The breakaway edge A runs along one leg of the angle β into the interior of the tube 20 and thus forms a breakaway step S relative to the front point of the breakaway edge A, the depth of which is >3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as the angle β.

Figure 3:
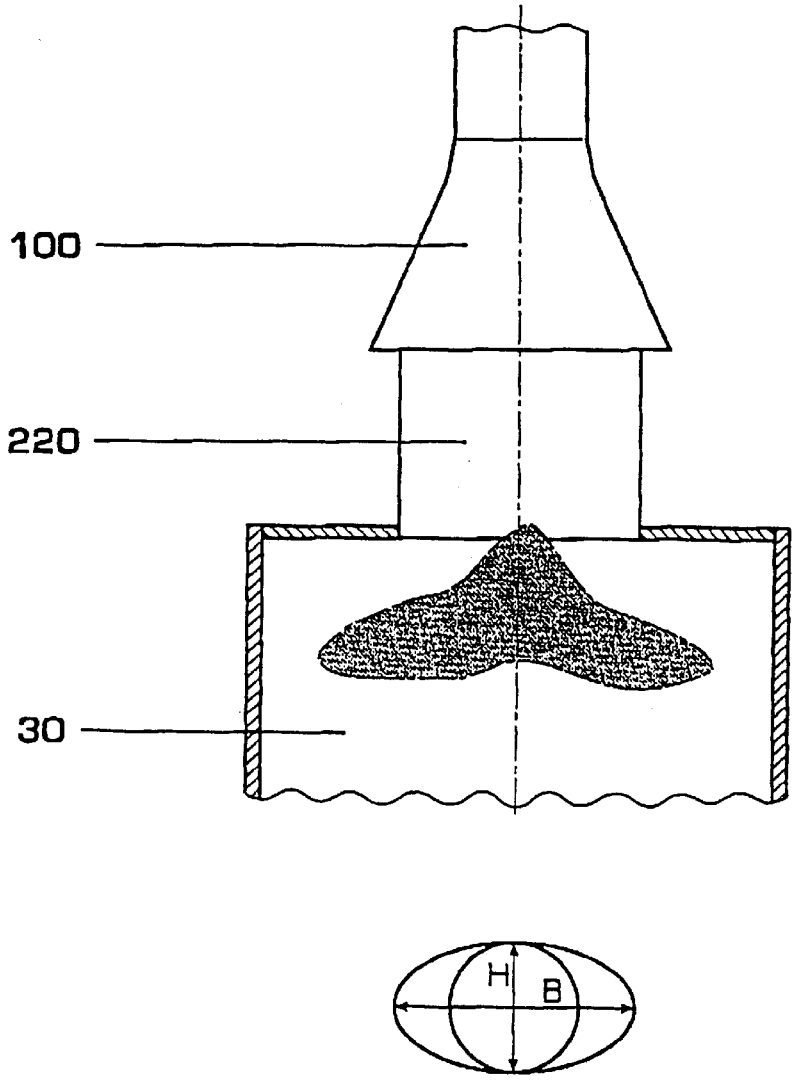
FIG. 3 shows a schematic representation of a burner according to the invention with an ellipsoidal outlet geometry and corresponding flame form.

FIG. 3 schematically shows an embodiment of a burner as disclosed by the prior art in its basic construction. According to the invention, however, the burner produces an ellipsoidal flame. A view against the direction of flow from below toward the burner is shown in the bottom half of the figure. This indicates that the shape of the transition from the mixing tube 220 to the combustion chamber 30 may be freely configured so as to be variable from a circle to an ellipse with a ratio of width B to height H of 3 at most by altering the radius R.

Figure 4:
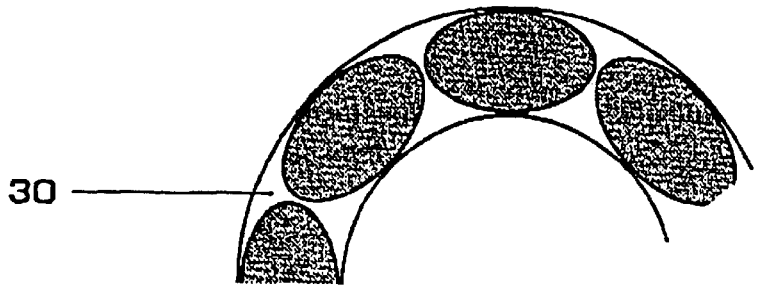
FIG. 4 shows a schematic representation of a combustion chamber with burners according to the invention, which have ellipsoidal flame forms.

In FIG. 4, a plurality of burners according to the invention having ellipsoidal flames are shown next to one another in a combustion chamber 30. The number of burners of a gas turbine may advantageously be reduced by this arrangement. In this case, design criteria such as the minimum distance of a burner from the combustion-chamer wall or the temperature behavior and cross-ignition behavior may be kept the same. Existing gas turbines are simple to convert with the present invention. It is also possible to adapt the flame form of an existing gas turbine by the flexible configuration from a circle to an ellipse.

What is claimed is:

1. A premix burner for a heat generator, essentially comprising:

a swirl generator for combustion air, means for spraying at least one fuel into the combustion air contained in the swirl generator; and a mixing section arranged downstream of the swirl generator and arranged upstream of a combustion chamber, and having, inside a first part of the mixing section in the direction of flow, a number of transition passages for passing a flow formed in the swirl generator into a mixing tube arranged downstream of these transition passages, the mixing tube having a breakaway edge with a radius in the region of the outlet adjacent the combustion chamber, wherein the radius is variable over the circumference of the mixing tube in such a way that a shape of a transition from the mixing tube to the combustion chamber is variable from a circle to an ellipse and consequently an ellipsoidal flame is obtained.

2. The burner as claimed in claim 1, wherein the ratio of the width to height of the ellipse of the ellipsoidal transition between mixing tube and combustion chamber is 3 at most.

3. The burner as claimed in claim 1, wherein the swirl generator comprises at least two hollow, conical sectional bodies which are nested one inside the other in the direction of flow, wherein the respective longitudinal symmetry axes of these sectional bodies run mutually offset in such a way that the adjacent walls of the sectional bodies form ducts, tangential in their longitudinal extent, for a combustion-air flow, and wherein at least one fuel nozzle can take effect in the interior space formed by the sectional bodies.

4. The burner as claimed in claim 1, wherein the mixing tube arranged downstream of the transition passages is provided with openings in the direction of flow and in the peripheral direction for injecting an air flow into the interior of the mixing tube.

5. The burner as claimed in claim 4, wherein the openings run at an acute angle relative to the burner axis of the mixing tube.

6. The burner as claimed in claim 1, wherein a combustion space is arranged downstream of the mixing section, wherein there is a jump in cross section between the mixing section and the combustion space, which jump in cross section induces the initial cross section of flow of the combustion space, and wherein a backflow zone can take effect in the region of this jump in cross section.

7. The burner as claimed in claim 6, wherein there is a diffuser section upstream of the backflow zone.

8. The burner as claimed in claim 1, wherein the mixing tube has a breakaway edge on the combustion-space side.

9. A premix burner for a heat generator, comprising:

a swirl generator for combustion air;

means for spraying at least one fuel into the combustion air contained in the swirl generator;

a mixing section arranged downstream of the swirl generator and arranged upstream of a combustion chamber, and having, inside a first part of the mixing section in the direction of flow, a number of transition passages for passing a flow formed in the swirl generator into a mixing tube arranged downstream of these transition passages, wherein a portion of the mixing tube adjacent to the combustion chamber has a varying radius forming a transition from the mixing tube to the combustion chamber which varies from a circle to an ellipse and consequently obtaining an ellipsoidal flame.

10. The burner as claimed in claim 9, wherein the swirl generator comprises at least two hollow, conical sectional bodies which are nested one inside the other in the direction of flow, wherein the respective longitudinal symmetry axes of these sectional bodies run mutually offset in such a way that the adjacent walls of the sectional bodies form ducts, tangential in their longitudinal extent, for a combustion-air flow, and wherein at least one fuel nozzle can take effect in the interior space formed by the sectional bodies.

11. The burner as claimed in claim 9, wherein the mixing tube arranged downstream of the transition passages is provided with openings in the direction of flow and in the peripheral direction for injecting an air flow into the interior of the mixing tube.

12. The burner as claimed in claim 11, wherein the openings run at an acute angle relative to the burner axis of the mixing tube.

13. The burner as claimed in claim 9, wherein a combustion space is arranged downstream of the mixing section, wherein there is a jump in cross section between the mixing section and the combustion space, which jump in cross section induces the initial cross section of flow of the combustion space, and wherein a backflow zone can take effect in the region of this jump in cross section.

14. The burner as claimed in claim 13, wherein there is a diffuser section upstream of the backflow zone.

15. The burner as claimed in claim 9, wherein the mixing tube has a breakaway edge on the combustion-space side.

* * * * *